United States Patent [19]

Coburn, Jr.

[11] Patent Number: 4,769,265

[45] Date of Patent: Sep. 6, 1988

[54] LAMINATED DECORATIVE FILM AND METHODS OF MAKING SAME

[76] Inventor: Joseph W. Coburn, Jr., P.O. Box 1585, Lakewood, N.J. 08701

[21] Appl. No.: 878,007

[22] Filed: Jun. 24, 1986

Related U.S. Application Data

[63] Continuation of Ser. No. 627,279, Jul. 2, 1984, abandoned, which is a continuation-in-part of Ser. No. 601,085, Apr. 16, 1984, abandoned, which is a continuation-in-part of Ser. No. 483,650, Apr. 11, 1983, abandoned, which is a continuation-in-part of Ser. No. 457,039, Jan. 10, 1983, abandoned.

[51] Int. Cl.[4] ..... B44F 1/14; G09F 3/10

[52] U.S. Cl. ..... 428/40; 428/46; 428/323; 428/690

[58] Field of Search ..... 428/13, 40, 46, 67, 428/323, 690

[56] References Cited

U.S. PATENT DOCUMENTS

| | | | |
|---|---|---|---|
| 2,133,081 | 10/1938 | Colvin | 428/30 |
| 2,748,019 | 5/1956 | Schramm, Jr. | 427/195 |
| 3,399,070 | 8/1968 | Scharf | 428/372 X |
| 3,536,551 | 10/1970 | Simon | 156/64 |
| 3,560,294 | 2/1971 | Potkanowicz | 156/276 |
| 3,592,722 | 7/1971 | Morgan | 428/40 X |
| 3,749,629 | 7/1973 | Andrews et al. | 156/276 |
| 3,873,390 | 3/1975 | Cornell et al. | 428/328 X |
| 3,940,523 | 2/1976 | Lecoeur et al. | 428/46 X |
| 4,032,291 | 6/1977 | Dellian | 8/34 |
| 4,054,699 | 10/1977 | Brinkley | 428/46 X |
| 4,104,102 | 8/1978 | Eagon et al. | 156/298 |
| 4,248,917 | 2/1981 | Hornibrook et al. | 428/323 X |
| 4,386,123 | 5/1983 | Coburn, Jr. | 428/542.2 X |

*Primary Examiner*—Henry F. Epstein
*Attorney, Agent, or Firm*—R. Gale Rhodes, Jr.

[57] ABSTRACT

Laminated decorative film including a layer of dry decorative particles residing between and adhered to opposed layers of dry adhesive residing, respectively, on opposed surfaces of a layer of support material and a layer of clear plastic film; the decorative particles are dry in the sense that they are not suspended in a solution or a mixture of adhesive including solvent and the adhesive is dry in the sense that at the time the decorative particles are applied thereto no solvent is present. Thermal die cuttable laminated decorative film is provided by providing the clear plastic film and support material from thermoplastic material and by using a thermoplastic adhesive. In an alternate embodiment of the invention, a layer of dry adhesive is embossed to provide angular surfaces for receiving and orienting the dry decorative particles at angles with respect to the layer of support material whereby upon light striking the angularly oriented decorative particles the light is reflected at various angles to cause the laminated decorative film to provide an enhanced visual effect. In a further alternate embodiment of the laminated decorative film, a layer of generally transparent film having a predominant reflection color is included, e.g. predominantly BLUE/GREEN or predominantly RED/-GREEN reflection color when viewed at 90° against a black background, which provides the laminated decorative film with an overall golden color without the use of dyes.

17 Claims, 4 Drawing Sheets

LAMINATED DECORATIVE FILM AND METHODS OF MAKING SAME

CROSS REFERENCE TO RELATED APPLICATIONS

This is a continuation of application Ser. No. 06/627,279, filed July 2, 1984 now abandoned which application is a continuation-in-part application of patent application Ser. No. 06/601,085 filed Apr. 16, 1984 and now abandoned which in turn is a continuation-in-part application of patent application Ser. No. 06/483,650 filed Apr. 11, 1983 (now abandoned) which in turn is a continuation-in-part application of patent application Ser. No. 06/457,039 filed Jan. 10, 1983 (now abandoned) and entitled "Laminated Decorative Film and Methods of Making Same."

FIELD OF THE INVENTION

This invention relates to new and useful laminated decorative film and to new and useful methods of making the same.

BACKGROUND OF THE INVENTION

Innumerable laminated decorative films, such expression as used herein including the reflective and retroreflective laminated films, are known to the prior art and such have been widely used for innumerable industrial and commercial purposes including decals, signs, posters, highway signs, traffic markers, artists' layout materials, etc. Such laminates typically include a layer of decorative particles (e.g. metal flake, pigment, glass beads, etc.) adhered to or between a layer or layers of plastic film or between a layer of plastic film and a support layer such as a layer of suitable release paper.

The laminated films are also made by virtually innumerable specific methods, but such methods typically have the common feature of using what is commonly referred to as an adhesive solution or an adhesive in solution, i.e. an adhesive including a solvent such as water, MEK (methyl-ethyl-ketone), toluol, acetone, alcohol, naptha, etc., such adhesive sometimes referred to in the art as a wet adhesive. In typical prior art practice, either a layer of wet adhesive is applied to a support surface, such as a layer of plastic film or release paper, and a layer of decorative particles is applied over the wet adhesive, or the decorative particles are immersed or suspended in a wet adhesive and the mixture of wet adhesive and decorative particles is applied to a support layer, such decorative particles sometimes said to be in solution. Prior art laminates and methods of making the same, of the type noted above, are discovered in U.S. Pat. Nos. 2,748,019; 3,399,070; 3,536,551; 3,560,294; 3,749,629; 3,873,390; 4,032,291; and 4,104,102.

Refererring more particularly to the prior art, and specifically to the prior art method of making laminated film illustrated diagrammatically in FIG. 1, decorative particles in solution indicated generally by numerical designation 10 are applied in a layer to the bottom surface of a layer of clear plastic film 12 by a transfer roll 16 as the film advances from a let-off roll 14 between the transfer roll 16 and a pressure roll 18. Thereafter, the plastic film now having the layer 10 of decorative particles in solution on its top surface after passing over the pressure roll 18 is advanced between a pair of nip rollers 20–22 where it is laminated to a layer of release paper 24 advancing from a letoff roll 26 whereupon the lamination is advanced and taken upon a suitable take-up roll 28. Various problems are known to the prior art method illustrated in FIG. 1, e.g. there must be chemical compatibility between the decorative particles and the wet adhesive, particularly between the decorative particles and the solvent, or else the solvent will degrade the particles sometimes to the point of ruination such as by dissolving, or partially dissolving, the particles. Further, when such decorative particles are immersed or suspended in the wet adhesive there is a settling problem due to the fact that the decorative particles and the wet adhesive have different specific gravities or densities and hence the particles tend to settle out preventing the application of a uniform mixture of decorative particles and wet adhesive; a similar problem is that of viscosity which can be caused by varying concentrations of the decorative particles and wet adhesive. Still further, since the adhesive is a wet adhesive as described above, temperature problems can arise requiring the process to be performed in a controlled temperature environment which, of course, can add unwanted expense to the cost of manufacture and hence to the cost of the end product.

A further method known to the prior art for producing such decorative foils or lamainates includes the step of applying a liquid film of plastic material over the decorative particles whereby upon solidification of the liquid film to form a solid a sheet-locked matrix of particles and plastic is provided; this process is known to have the problem of non-uniform scattering of the particles throughout the thickness of the film whereby unwanted variations in color or visual appearance are presented.

As is further known to those skilled in the art, various industrial and commercial uses of such decorative films or laminates require, or make it highly desirable for various reasons such as cost, that the decorative film or laminate be thermal die cuttable instead of requiring cutting by the more expensive steel rule die process.

Accordingly, there exists a need in the laminated decorative film art for a laminated decorative film wherein the decorative particles are provided in a more uniform layer and for a method for making the same wherein the above-noted problems of chemical compatibility, settling, viscosity, and temperature environment, etc. are overcome. Still further, there exists a need in the art for a decorative laminated film which is thermal die cuttable.

SUMMARY OF THE INVENTION

In the present invention, a layer of dry decorative particles resides between and is adhered to opposed layers of dry adhesive residing, respectively, on opposed surfaces of a layer of support material and a layer of clear plastic film. As taught in detail below, the decorative particles are dry in the sense that they are not suspended in solution or a mixture of adhesive including solvent and the adhesive is dry in the sense that at the time that the decorative particles are applied thereto no solvent is present.

Thermal die cuttable laminated decorative film is provided by providing the clear plastic film and support material from thermoplastic material and by using a thermoplastic adhesive.

DETAILED DESCRIPTION OF THE PREFERRED EMBODIMENT

Figure 1:
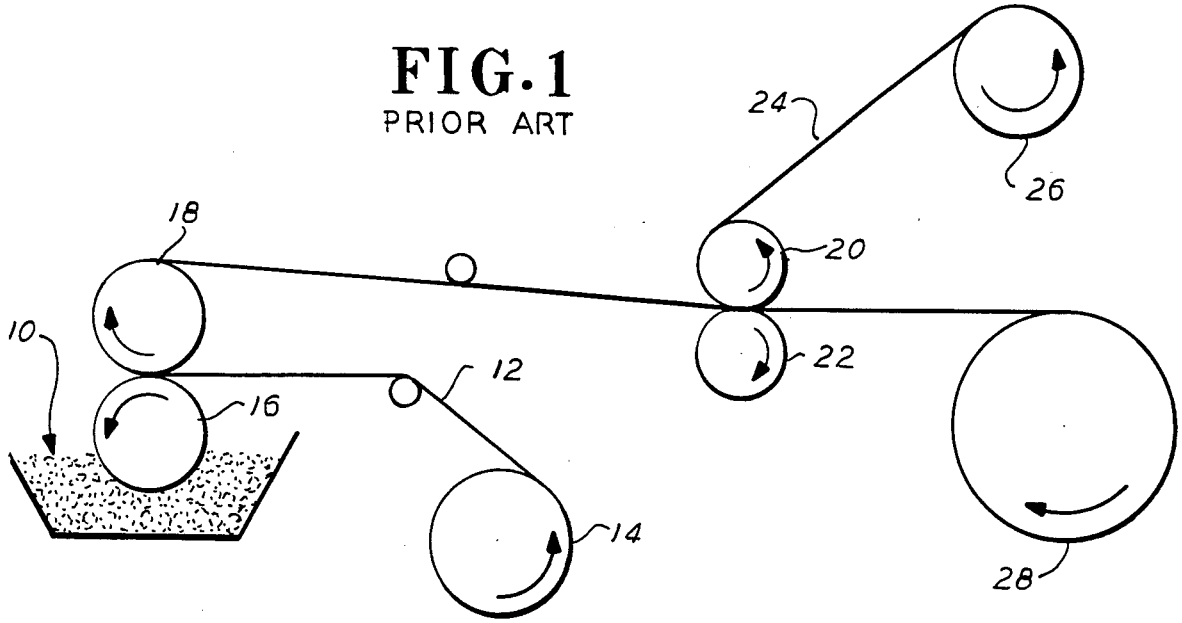
FIG. 1 PRIOR ART
FIG. 1 is a diagrammatic illustration of the prior art method of making laminated decorative film referred to above.
Figure 2:
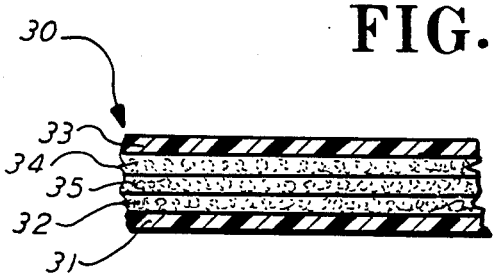
FIG. 2 is a partial, enlarged cross-sectional view of laminated decorative film embodying the present invention.

Referring now to FIG. 2, there is shown a laminated decorative film embodying the present invention and identified by general numerical designation 30. The laminated decorative film 30 may include a layer of support material 31, a layer of dry adhesive 32, a layer of clear plastic film 33, a layer of dry adhesive 34 and a layer of dry decorative particles 35 residing between and adhered to the layers of dry adhesive 32 and 34.

The term "dry adhesive" as used in this specification and in the appended claims is used to mean a substantially transparent adhesive which, at the time the decorative particles are applied thereto, is dry in the sense that at such time no solvents, of the type noted above, are present whether previously present and previously dried off. An example of such "dry adhesive" useful in the preferred embodiment of this invention is a 100% solids adhesive such as commercially available acrylic hot melt pressure sensitive adhesive. It will be further understood by those skilled in the art that such "dry adhesive" may be tacky or slightly tacky at the time the decorative particles are applied thereto. The term "dry decorative particles" is used in this specification and the appended claims to mean decorative particles which at the time they are applied are not in solution or suspended in a mixture of wet adhesive and solvent.

Figure 3:
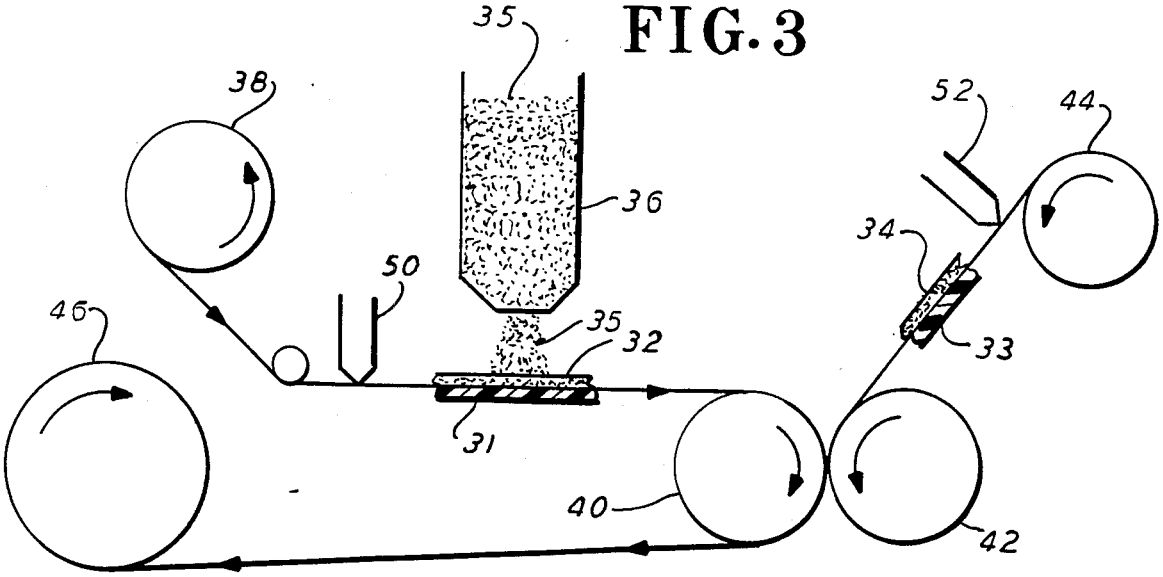
FIG. 3 is a diagrammatic illustration of a method of making laminated decorative film according to the present invention.

Referring now to FIG. 3 and the method of the present invention, a layer of dry decorative particles 35 is dispensed from a suitable hopper 36 and applied to a layer of dry adhesive 32 residing on and adhered to the top surface of a layer of support material 31 as they are advanced beneath the hopper 36; for clarity of understanding, the layer of support material 31 and layer of dry adhesive 32 are partially shown in enlarged cross-sectional view beneath the hopper 36. Thereafter, support material 31 and dry adhesive 32 having the layer of dry decorative particles 35 thereon, are advanced between a pair of nip rollers 40–42 where lamination takes place with a layer of clear plastic film 33 having a layer of dry adhesive 34 residing on and adhered to its top surface and subsequently the lamination is advanced onto take-up roll 46; for clarity of understanding, a layer of clear plastic film 33 and a layer of dry adhesive 34 are partially shown in enlarged cross-sectional view intermediate the let-off roll 44 and the nip roll 42. It will be understood that the layer of dry adhesive 32 may be applied to the top surface of the layer of support material 31 intermediate the let-off roll 38 and the hopper 36 by a suitable dry adhesive applicator indicated diagrammatically at 50 and, similarly, the layer of dry adhesive 34 may be applied to the top surface of the layer of clear plastic film 33 intermediate the let-off roll 44 and nip roll 42 by a suitable dry adhesive applicator indicated diagrammatically at 52.

It will be further understood that in accordance with the further teachings of the present invention, pressure and heat may be applied to the lamination between the nip rolls 40 and 42 by suitable structure associated with the nip rolls which may be anyone of several types known to the prior art.

In one embodiment of the present invention, the layer of support material 31 was a layer of 90 lb. stay flat silicone coated release liner, the dry adhesive 32 and 34 were layers of acrylic hot melt pressure sensitive adhesive, 0.002 inch thick, the layer of clear plastic film 33 was a layer of vinyl, 0.003 inch thick, the heat and pressure applied to the lamination between the nip rolls 40 and 42 were, respectively 120° F.–150° F. and approximately 40 lbs. per square inch; and the dry particles 35 were what is commonly referred to in the art as "glitter" metallized plastic film.

In accordance with the further teachings of the present invention, it will be understood that the laminated decorative film 30 of the present invention may be thermal die cuttable by providing the layer of support material 31 and layer of clear plastic film 33 from the thermoplastic film such as acrylic or vinyl and by providing the layers of dry adhesive 32 and 34 from acrylic heat melt pressure sensitive adhesive whereby the lamination may be readily cut by a suitable thermal die with the thermal die easily separating the layer of dry decorative particles 35 even though such particles are not themselves thermal die cuttable.

In accordance with the further teachings of the present invention, it will be understood that such dry decorative particles may be chosen from a group consisting of finely chopped aluminum, finely chopped aluminum foil chips, finely chopped metallized plastic film (colored or clear), glass beads, phosphorescent pigment, fluorescent pigment, transparent iridescent film (e.g. Mearl Iridescent Film IF-5121), and suitable equivalents.

Referring again to the present invention, it will be understood that by use of the above-noted dry decorative particles and dry adhesive there is no requirement of chemical compatibility between the decorative particles and the adhesive and hence no limitation is placed on the decorative particles that may be used by the chemical composition at the time the decorative particles are applied to the adhesive. Still further, it has been found that such application of dry particles to the dry adhesive provides a more uniform or even layer of dry particles than do the prior art methods described in the introductory portion of this specification.

Figure 5:
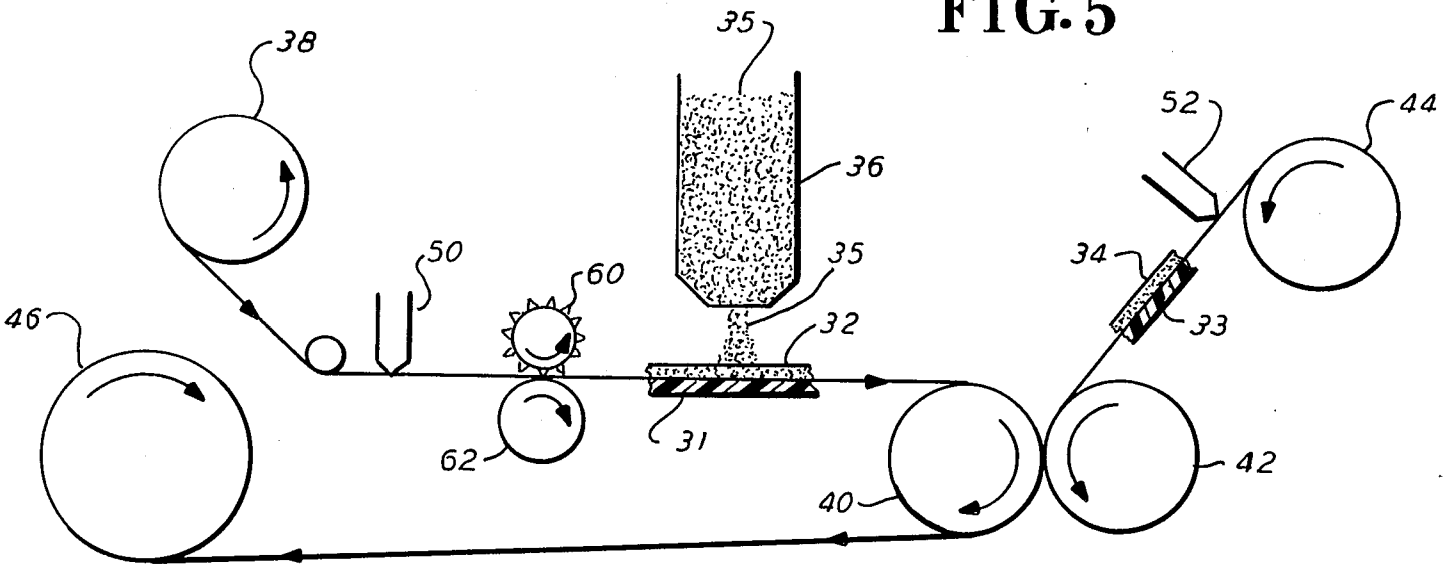
FIGS. 4–6 illustrate diagrammatically an alternate embodiment of the present invention.
Figure 6:
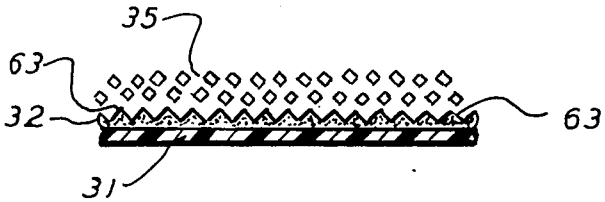
Figure 4:
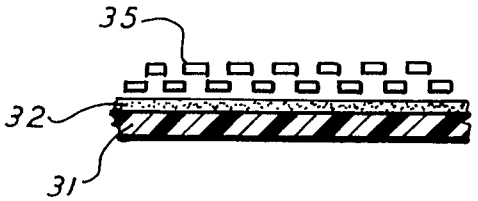

Referring now to FIGS. 4–6, an alternate embodiment of the present invention is illustrated diagrammatically in FIG. 5 and 6 and in these FIGS. objects identical to those shown in FIGS. 2–3 have identical numerical designations. Referring first to FIG. 4, it will be understood that in accordance with the earlier teachings of the present invention as illustrated diagrammatically in FIG. 3, the layer of dry adhesive 32 applied to the layer of support material 31 by the dry adhesive applicator 50 is a flat layer of dry adhesive as shown in FIG. 4 whereby the decorative particles 35 received by the flat layer of dry adhesive 32 are oriented flat or parallel to the layer of support material 31. Hence, light striking the flatly oriented dry decorative particles 35 is reflected uniformly to cause the laminated decorative film 30 to provide a substantially uniform visual effect. However, in accordance with the teachings of the alternate embodiment of the present invention, the dry adhesive 32, as illustrated diagrammatically in FIG. 6, is embossed to provide angular surfaces 63, i.e. surfaces oriented at angles with respect to the layer of support material 31, which angular surfaces 63 upon receiving the dry decorative particles 35 orient the decorative particles at angles with respect to the layer of support material 31, as shown in FIG. 6, whereby upon light striking the angularly oriented decorative particles the light is reflected at various angles to cause the laminated decorative film 30 to provide an enhanced visual effect. Referring to FIG. 4, it will be further understood that in accordance with the teachings of the present invention, the invention may include an embossing roller 60 supported suitably opposite a support or back-up roll 62 intermediate the dry adhesive applicator 50 and the dry decorative particle hopper 36 whereby upon the dry adhesive 32 applied to the layer of support material 31 passing between the embossing roller 60 and the back-up roller 62, the dry adhesive 32 is embossed, as illustrated diagrammatically in FIG. 6, to provide the plurality of angularly oriented surfaces 63.

Referring now to FIGS. 7–11, an alternate embodiment of the present invention is illustrated wherein the dry decorative particles or glitter to be incorporated into the laminated decorative film of the present invention as taught above are embossed dry decorative particles. It has been discovered that the reflectivity and brightness of the laminated decorative film of the present invention may be enhanced if the dry decorative particles are embossed particles because the embossed particles have a greater effective viewing length, and they may be viewed effectively through a greater viewing angle, than can the flat or platelet particles. This permits the laminated decorative film of the present invention to be manufactured with less dry decorative particles or glitter thereby reducing the cost of the film but providing no decrease, instead providing an increase, in brightness or reflectivity.

More particularly, it has been discovered that embossing of the metallized plastic film or metal foil from which the dry decorative particles are to be chopped provides the film or foil with increased rigidity which enhances the ability of the film or foil to be fed into the chopping machine in which the film or foil is chopped into the finely divided decorative particles or glitter. For example, it has been found that only flat or unembossed metallized plastic film or foil having a thickness of approximately 0.0075 inch or greater can be fed into a chopping machine, and if fed thinner, chopping cannot be effectively accomplished because the film or foil tends to wrinkle or wad up resisting chopping. However, it has been discovered that embossed metallized plastic film or foil having a thickness as small as 0.0035 inch, and apparently thinner, can be effectively fed into the chopping machine without wrinkling or wadding. This permits the embossed dry decorative particles or glitter to be thinner and of less weight than the flat or platelet particles made from the flat or unembossed film or foil, and hence the embossed dry decorative particles will have less tendency to settle into the dry adhesive than do the heavier flat particles. Thus, less embossed dry decorative particles are required to produce laminated decorative film having the same, or even greater, reflectivity or brightness and a reduction in cost without a reduction in brightness or reflectivity is achieved.

Figure 7:
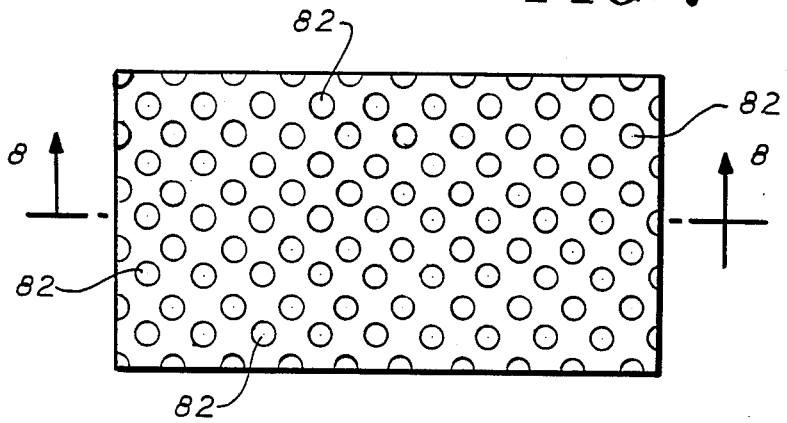
FIG. 7 is a plan view of embossed metallized plastic film which may be chopped into dry decorative particles.
Figure 8:
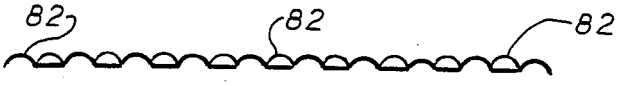
FIG. 8 is a cross-sectional view taken along the line 8—8 in FIG. 7 in the direction of the arrows.

Referring now specifically to FIG. 7, there is shown in plan view a layer of transparent metallized plastic film, e.g. metallized clear polyester, which has been embossed to provide a plurality of domed or substantially semi-hemispherical portions 82, which domed or semi-hemispherical portions 82 may be better seen in cross-section in FIG. 8. It will be understood that such embossing may be accomplished by suitable embossing rollers well known to those skilled in the embossing art.

Figure 9:
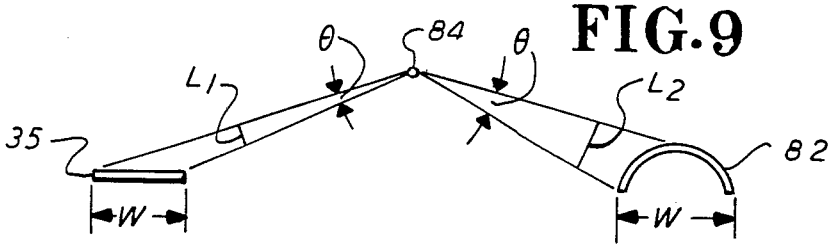
FIGS. 9 and 10 are diagrammatical illustrations showing how the embossed dry decorative particles of the present invention enhance reflectivity and provide a greater range of viewing angles.
Figure 10:
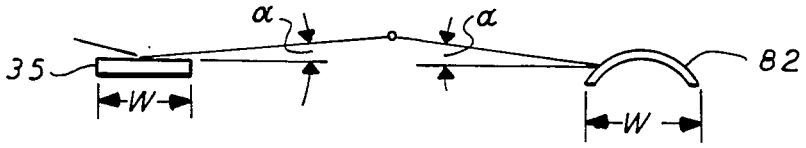

Referring now to FIG. 9, it will be noted that when viewed from a common viewing point 84, the flat or platelet dry decorative particle 35 has a smaller effective viewing length L1 than does the domed dry decorative particle 82 which has the larger effective viewing length L2, where both viewing lengths are at common viewing angles $\theta$; similarly, as illustrated in FIG. 10, when viewed at common viewing angles $\alpha$, it will be noted that the flat or platelet dry decorative particle 35 will provide little reflectivity and hence brightness whereas the domed dry decorative particle 82 will provide great light reflectivity and hence great brightness.

Figure 11:
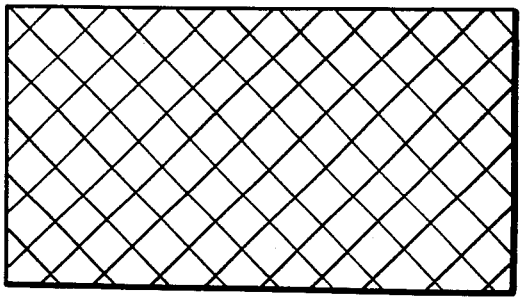
FIG. 11 is an alternate embodiment of embossed metallized plastic film similar to that of FIG. 7 but having a different embossing pattern.

Referring to FIG. 11, it will be understood that in accordance with the teachings of the present invention the embossed dry decorative particles may be provided with various embossing patterns, such as the diamond pattern of FIG. 11, in addition to the circular row pattern of FIG. 7.

In addition to the materials taught above as being suitable for producing dry decorative particles, it has been discovered that Melinex of ICI, Inc., when metallized and finely chopped, also provides particularly useful dry decorative particles; Melinex is the trademark of ICI, Inc. and is a clear or transparent polyester film. It has been discovered that when dry decorative particles or glitter made from such Melinex film are incorporated into the laminated decorative film of the present invention, an increased brightness and attractiveness are provided.

Figure 12:
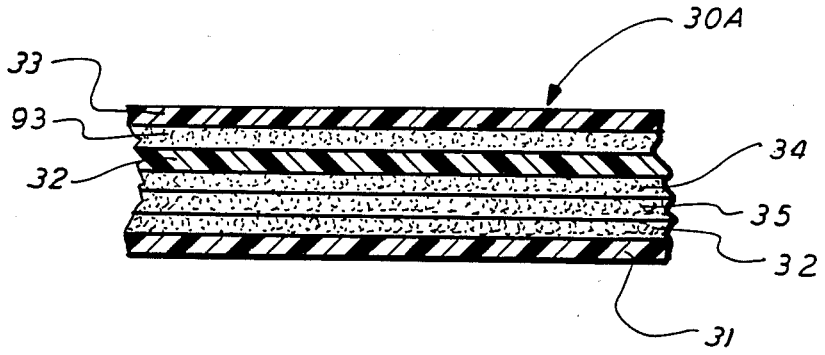
FIG. 12 is a partial, enlarged cross-sectional view of alternate laminated decorative film embodying the present invention.

Referring now to FIG. 12, there is shown a further alternate embodiment of laminated decorative film according to the present invention which film is indicated by general numerical designation 30A and wherein included layers identical to those of the laminated decorative film 30 of FIG. 2 are given identical numerical designations; accordingly, it will be understood that laminated decorative film 30A includes a layer of support material 31 (e.g. a layer of suitable release paper), layers of dry adhesive 32 and 34, and a layer of dry decorative particles 35. In addition, this alternate embodiment of film 30A includes a layer 92 of generally transparent film having either predominantly BLUE/GREEN or predominantly RED/GREEN reflection color when viewed at 90° against a black background of substrate, and a layer of dry adhesive 93. The layer of generally transparent film having predominantly BLUE/GREEN reflection color when viewed at 90° against a black background may be a layer of Mearl Iridescent Film IF-5121 BLUE/GREEN and the layer of generally transparent film having a predominantly RED/GREEN reflection color when viewed at 90° against a black background may be a layer of Mearl Iridescent FILM IF-5121 RED/GREEN, both available from The Mearl Corporation, Decorative Film Division, Peekskill, N.Y. 10566. The layer of dry adhesive 93 may be one of the layers of dry adhesive taught above.

A still further alternate embodiment of laminated decorative film according to the present invention is identical to that disclosed in FIG. 12 and described above with the exception that the layer of dry adhesive 93 is eliminated and the layer of clear plastic film 33 is bonded or fused to the layer of film 92; such bonding or fusing may be accomplished by the application of suitable heat and pressure, e.g. heat of approximately 250° F. and pressure of approximately 50 psi.

It has been discovered that the incorporation of the layer of film 92 taught above into the laminated decorative film 30A of FIG. 12, and the alternate embodiment described above wherein the layer of dry adhesive 93 is eliminated, produces laminated decorative film having a general or overall golden color without the use of dyes and which has an improved attractive iridescent quality. The elimination of dyes reduces the complications and hence cost of producing the laminated decorative film.

Referring again to the Mearl Iridescent Film IF-5121 mentioned above as suitable for producing dry decorative particles, Mearl is the tradename of The Mearl Corporation of Peekskill, N.Y.

It further will be understood by those skilled in the art that many modifications and variations of the present invention may be made without departing form the spirit and scope thereof.

What is claimed is:

1. Laminated decorative film comprising:

a layer of support material having a layer of dry adhesive applied thereto;

a layer of substantially transparent plastic film having a layer of substantially transparent dry adhesive applied thereto, said layers of adhesive opposite each other; and a layer of dry decorative particles residing between and adhered to said layers of dry adhesive.

2. Laminated decorative film according to claim 1 wherein said layers of dry adhesive are layers of 100% solids adhesive.

3. Laminated decorative film according to claim 2 wherein said 100% solids adhesive is acrylic hot melt pressure sensitive adhesive.

4. Laminated decorative film according to claim 1 wherein said layer of decorative particles is chosen from a group consisting of finely chopped aluminum, finely chopped aluminum foil chips, finely chopped colored or clear metallized plastic film, glass beads, phosphorescent pigment, fluoroescent pigment, transparent iridescent film particles, finely chopped embossed metal foil chips, finely chopped embossed metallized plastic film and finely chopped metallized Melinex Film.

5. Laminated decorative film according to claim 1 wherein said laminated decorative film is thermal die cuttable laminated decorative film and wherein said layer of support material and said layer of substantially transparent film are thermoplastic films and wherein said layers of dry adhesive are thermoplastic adhesives.

6. Laminated decorative film according to claim 1 wherein said layer of dry adhesive applied to said layer of support material is an embossed layer of dry adhesive which embossed layer of dry adhesive provides additional surface area for receiving said decorative particles whereby additional decorative particles are received on said layer of embossed dry adhesive to cause the visual effect provided by said laminated decorative film to be enhanced.

7. Laminated decorative film according to claim 1 wherein said layer of dry adhesive applied to said layer of support material is an embossed layer of dry adhesive material which embossed layer of dry adhesive material provided angular surface areas which orient said decorative particles at angles with respect to said layer of support material whereby upon light striking said angularly oriented decorative particles said light is reflected angularly to cause said laminated decorative film to provide an enhanced visual effect.

8. Laminated decorative film comprising from bottom to top:

(a) a layer of support material;

(b) a layer of dry adhesive;

(c) a layer of dry decorative particles;

(d) a layer of substantially transparent dry adhesive; and (e) a layer of substantially transparent plastic film.

9. Laminated decorative film according to claim 8 wherein said film further includes between layers (d) and (e):

(f) a layer of predetermined generally transparent film having a predetermined predominant reflection color.

10. Laminated decorative film according to claim 9 wherein layer (f) is bonded to layer (e).

11. Laminated decorative film according to claim 9 wherein said film further includes between layers (f) and (e):

(g) a layer of substantially transparent dry adhesive.

12. Laminated decorative film according to claim 9 wherein said layer of predetermined generally transparent film having a predetermined predominant reflection color is a layer of generally transparent film having predominantly BLUE/GREEN reflection color when viewed at 90° against a black background.

13. Laminated decorative film according to claim 9 wherein said layer of predetermined generally transparent film having a predetermined predominant reflection color is a layer of generally transparent film having predominantly RED/GREEN reflection color when viewed at 90° against a black background.

14. Film according to claim 1 or 8 wherein said dry decorative particles are embossed dry decorative particles.

15. Film according to claim 14 wherein said embossed dry decorative particles are generally domed dry decorative particles.

16. Film according to claim 15 wherein said generally domed dry decorative particles have a generally semihemisperical cross-sectional shape.

17. Film according to claim 14 wherein said dry decorative particles have a generally triangular cross-sectional shape.

* * * * *